US008335295B1

(12) United States Patent
Uduka

(10) Patent No.: US 8,335,295 B1
(45) Date of Patent: Dec. 18, 2012

(54) IMAGE INTENSIFIER

(75) Inventor: Ryuichi Uduka, Yaita (JP)

(73) Assignees: Kabushiki Kaisha Toshiba, Tokyo (JP); Toshiba Electron Tubes & Devices Co., Ltd., Tochigi-Ken (JP)

( * ) Notice: Subject to any disclaimer, the term of this patent is extended or adjusted under 35 U.S.C. 154(b) by 1372 days.

(21) Appl. No.: 11/959,050

(22) Filed: Dec. 18, 2007

(30) Foreign Application Priority Data

Dec. 19, 2006 (JP) ..... 2006-340998

(51) Int. Cl.
*H05G 1/64* (2006.01)

(52) U.S. Cl. ..... 378/98.2; 313/371

(58) Field of Classification Search ..... 378/98, 378/98.2, 98.3, 98.6; 313/371, 106, 107, 313/529, 528, 524
See application file for complete search history.

(56) References Cited

U.S. PATENT DOCUMENTS 5,059,854 A * 10/1991 Smits ..... 313/107
6,147,446 A * 11/2000 Pradere ..... 313/371

FOREIGN PATENT DOCUMENTS

JP 58-005319 1/1983
JP 06-243806 9/1994
JP 2005-268197 9/2005
JP 02005268197 A * 9/2005

OTHER PUBLICATIONS

Chinese Office Action dated Jan. 15, 2010 for Appln. No. 200710300541.6.
Korean Office Action dated May 6, 2009 for Appln. No. 2007-133132.

* cited by examiner

*Primary Examiner* — Hoon Song
(74) *Attorney, Agent, or Firm* — Pillsbury Winthrop Shaw Pittman, LLP

(57) ABSTRACT

A chromium oxide film is formed so as to continuously connect an anode and a grid electrode, and an insulating member for insulating those electrodes. A chromium oxide film is formed so as to continuously connect a grid electrode and a grid electrode, and an insulating member for insulating those electrodes. With use of the chromium oxide films, no intermittent discharge phenomenon occurs between the insulating member and the anode, and between the insulating member and the grid electrodes.

15 Claims, 1 Drawing Sheet

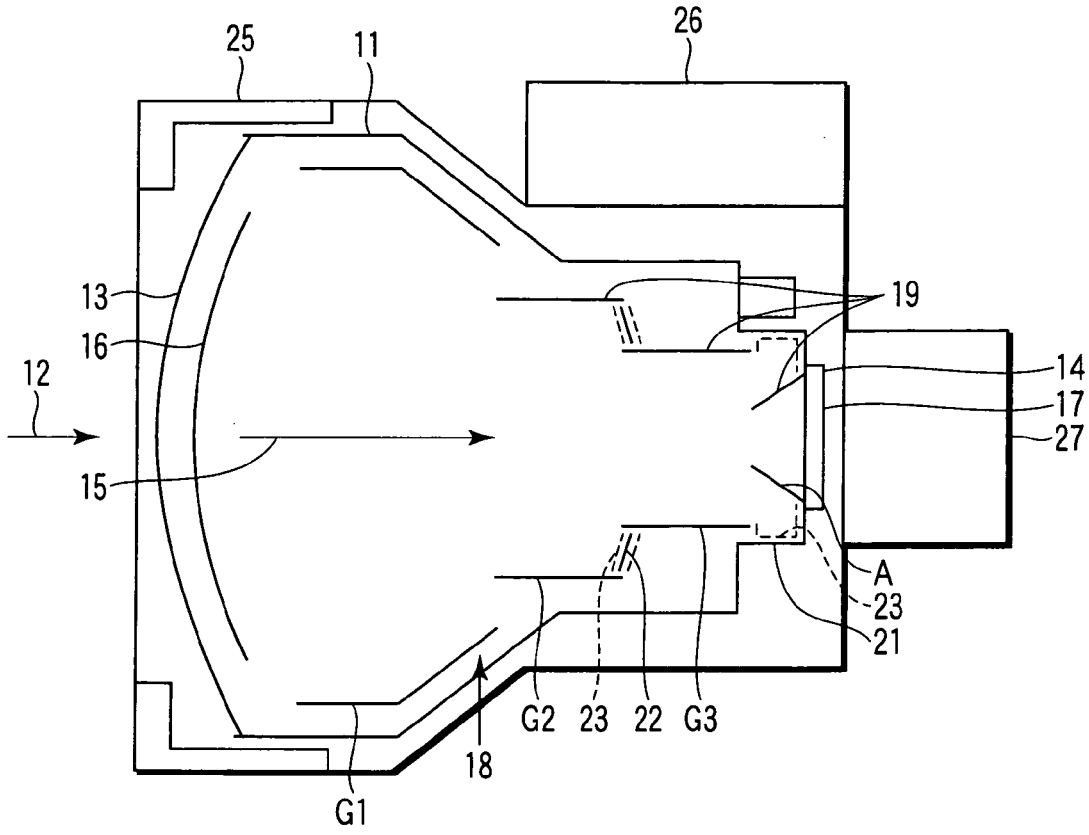
25
11
26
13
16
12
15
19
14
17
27
A
23
21
G2
23
22
G3
18
G1

IMAGE INTENSIFIER

CROSS-REFERENCE TO RELATED APPLICATIONS

This application is based upon and claims the benefit of priority from prior Japanese Patent Application No. 2006-340998, filed Dec. 19, 2006, the entire contents of which are incorporated herein by reference.

BACKGROUND OF THE INVENTION

1. Field of the Invention

The present invention relates to an image intensifier for converting an incident light image into a visible light image.

2. Description of the Related Art

In an X-ray diagnosis system for medical use, a nondestructive inspection device for industrial use, and an ultraviolet rays detection system for space observation, each of which uses an image intensifier, an image by X-rays, ultraviolet rays, neutron rays or the like, which has transmitted through an object, is converted into a visible light image by the image intensifier. The visible light image is then picked up by an image pickup camera, and this picked up image is visually presented to viewers on a monitor.

A conventional image intensifier includes a vacuum envelope having an input window located on the side which receives X-rays or the like and an output window on the opposite side to the input window. Within the vacuum envelope, an input surface which converts X-rays or the like into an electron beam and emits the electron beam, is provided on the inner side of the input window, and an output surface which converts the electron beam into a visible light image and outputs the image is provided on the inner side of the output window. Further, an electron lens for accelerating or condensing the electron beam is provided along the path of the electron beam which travels from the input surface to the output surface. The electron lens includes a cathode for applying negative voltage to the input surface, an anode for applying high positive voltage to the output surface, and a plurality of grid electrodes located between the cathode and the anode.

When high voltage for bulb driving purpose is applied to the image intensifier thus constructed, a potential difference, for example, between the grid electrode and the anode reaches 6 kV/mm. The grid electrode is easy to emit electrons at such a portion that the intensity of the electric field is high and the potential gradient is high. When metal foreign matter is present on the grid electrode, the likelihood of electric field emission further increases. The heat caused by the electron emission causes the grid electrode to generate gas. The gas is ionized by the electrons and the generated ions collide with the grid electrode to emit secondary electrons. As a result, the local abnormal discharge continues and reaches the input surface. The discharge causes the photoelectric layer to emit unwanted photoelectrons, the photoelectrons hit the output surface, and in turn the output surface fluoresces. This forms a major cause for a so-called unwanted fluorescence of the image intensifier. The unwanted photoelectrons cause the potentials at those electrodes to vary to make the operation of the image intensifier unstable.

An effective measure for those problems is to cover the portion having the potential gradient, including the grid electrodes, with a material which has a low secondary electron emission coefficient but a certain level of conductivity. A typical example of the material is a chromium oxide film (see, for example, Jpn. Pat. Appln. KOKAI Publication No. 58-5319, pages 1 to 2, FIG. 1).

In the case of the existent chromium oxide film, the adhesive force of the film to the electrode or the like is poor and the interparticle binding force is also poor. Further, the chromium oxide film is easy to be separated by vibration and impact in the manufacturing stage or when it is used or when ambient conditions abruptly change. When the chromium oxide film is separated, the secondary electrons are emitted from the portion from which the chromium oxide film has been separated. This brings about the unwanted fluorescence and the unstable operation. Additionally, the separated film pieces are present as foreign matter in the bulb. This leads to defective products, lowering production yield and product quality. A known technique to increase the adhesive force and the interparticle binding force is to add liquid glass or the like as a binder to the chromium oxide film. This technique has the following disadvantages, however. The conductivity of the chromium oxide film is easily lost. The secondary electrons are less emitted, but the high electric insulation brings about the charging of the film, causing dust attraction and unstable potential distribution in the bulb.

To cope with this problem, there is a proposal in which a composition ratio of the chromium oxide film is set at 25 to 40 atom % of chromium, 1 to 8 atom % of silicon, 0.7 to 5 atom % of alkali metal, and the remaining part of the content substantially consisting of oxygen. When the chromium oxide film has such a composition ratio, the following advantages are produced. Proper conductivity of the film and low secondary electron emission are secured with no dust attraction and no unwanted fluorescence. Its adhesive force to the film forming portion and the interparticle binding force are satisfactorily secured to prevent the film separation. As a result, secondary electron emission due to the film separation and product defectiveness due to the foreign matter in the bulb are successfully prevented.

In the case where metal foreign matter is present, it may be a discharge source even in a location where the potential difference between the grid electrode and the anode is far below 6 kV/mm.

The metal foreign matter is produced by burr produced at the time of working the electrodes, the rubbing of the electrodes when assembled into the bulb, at the time of welding, and the like. The metal foreign matter may be put out of the bulb in certain levels by removing the burr, improving the assembling process, modifying the welding conditions to reduce the likelihood of performing the welding work in the bulb, and further by tapping and cleaning the inside of the bulb. Even when those approaches to remove the metal foreign matter are used, it is almost impossible to completely remove the metal foreign matter from the bulb.

The metal foreign matter is made of SUS, AL, Cu and the like and sometimes takes the form of needle 50 to 200 microns long. A coulomb force acts on the metal foreign matter of such a size in the electric field of 0.5 kV/mm or higher, and the metal foreign matter moves around. The following fact was experimentally confirmed: when the image intensifier is operating, metal foreign matter having been present in the bulb is placed on the grid electrode, and behaves to rise and float toward the anode by Coulomb force. An electric field concentrates at the metal foreign matter, discharging current flows, and the metal foreign matter is molten to bond to the grid electrode. The discharging is continuously performed and eventually the image intensifier is damaged to be inoperable.

This problem was successfully solved in such a manner that the chromium oxide film is formed at such a location of the electrode where the electric field is 0.5 kV/mm or higher. 0.5 kV/mm of the electric field is a critical value at which the metal foreign matter is allowed to move around under the Coulomb force. If the grid electrode is protected by the chromium oxide film, even when the metal foreign matter rises by the Coulomb force and the electric field concentrates thereat, the discharging is prevented. Even if the discharging occurs, the metal foreign matter is not molten to bond to the grid electrode and thus no serious continuous discharge occurs (see, for example, Jpn. Pat. Appln. KOKAI Publication No. 2005-268197, page 4, FIG. 1).

As mentioned above, the problem of the continuous discharging phenomenon caused by the metal foreign matter was substantially solved. Through calculations, experiments and trial production, it has been found that an unwanted intermittent discharging phenomenon occurs from the spaces between a plurality of electrodes and the insulating member for insulating those electrodes.

It was found that the intermittent discharging phenomenon was due to an intermittent arcing occurring in the interface between the spaces between the electrodes and the insulating member for insulating those electrodes. Even in the case of the typical 9-inch image intensifier, high voltage of 27 kV is applied to between the anode and the grid electrode functioning as an expanding electrode. Usually, those are both insulatingly supported by the glass bulb of the vacuum envelope, for example. Electrons emitted from the grid electrode under the electric field negatively charge the glass bulb and the potential difference between the glass bulb and the anode gradually increases. When the potential difference exceeds a threshold value for the dielectric breakdown, arcing occurs in the interface between the glass bulb and the anode. The arcing light enters the input surface to cause the photoelectric surface to emit unwanted photoelectrons, and then the unwanted photoelectrons cause the output surface to wrongly fluoresce. Then, the charging mentioned above starts, arcing occurs, and the output surface fluoresces. Repeating of such a process leads to the intermittent discharge phenomenon. The interval of the intermittent discharge phenomenon varies depending on the bulb structure, applied voltage and the like. Generally, it ranges from several hundred milliseconds to several hundred seconds. The phenomenon lowers the diagnosis level in the medical field and the nondestructive inspection field.

BRIEF SUMMARY OF THE INVENTION

Accordingly, an object of the present invention is to provide an image intensifier which is capable of preventing the intermittent discharge phenomenon and has a high reliability.

The present invention provides an image intensifier comprising: a vacuum envelope having an input window which is formed in a side thereof on which incident light is incident, and an output window which is formed in a side thereof opposite to the input window; an input surface which is provided on the input window side within the vacuum envelope and emits an electron beam corresponding to the incident light; an output surface which is provided on the output window side within the vacuum envelope and converts the electron beam into a visible light image; a plurality of electrodes which form an electron lens on a path of the electron beam between the input surface and the output surface; a plurality of insulating members which insulate those electrodes; and an chromium oxide film formed so as to continuously connect said plurality of electrodes and the insulating members located between those electrodes.

According to the present invention, a chromium oxide film is formed so as to continuously connect the plurality of electrodes and the insulating member for insulating the electrodes. With this characteristic feature, an image intensifier which is capable of preventing the intermittent discharge phenomenon and has a high reliability can be provided.

Additional objects and advantages of the invention will be set forth in the description which follows, and in part will be obvious from the description, or may be learned by practice of the invention. The objects and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

The single FIGURE is a conceptual diagram showing an image intensifier according to an embodiment of the present invention.

DETAILED DESCRIPTION OF THE INVENTION

An embodiment of the present invention will be described with reference to FIG. 1.

In FIG. 1, reference numeral 11 designates a vacuum envelope of an image intensifier, and an input window 13 is formed in the side of the vacuum envelope 11 on which the rays of incident light 12 such as X-rays, ultraviolet rays, neutron rays or the like, are incident, and an output window 14 is formed in the side thereof opposite to the input window 13. An input surface 16 for converting the incident light 12 into an electron beam 15 and emitting the electron beam is provided on the inner side of the input window 13 within the vacuum envelope 11. An output surface 17 for converting the electron beam 15 into a visible light image and outputting the visible light image is provided on the inner side of the output window 14.

An electron lens 18 for accelerating or condensing the electron beam 15 is provided along the path of the electron beam 15 which travels from the input surface 16 to the output surface 17. The electron lens 18 includes a cathode K for applying negative voltage to the input surface 16, an anode A for applying high positive voltage to the output surface 17, and a plurality of electrodes 19 such as grid electrodes G1, G2 and G3 located between the cathode K and the anode A.

The anode A and the grid electrode G3 are insulatingly supported through an insulating member 21 made of glass bulb of the vacuum envelope 11, ceramic or the like.

The grid electrode G3 and the grid electrode G2 are insulatingly supported through an insulating member 22 made of, for example, a bar-like glass or ceramic.

Although not shown, the grid electrode G1 is insulatingly supported by the vacuum envelope 11 through an insulating member made of glass or ceramic.

A chromium oxide film 23 is formed so as to continuously connect the anode A, the grid electrode G3 and the insulating member 21 (the inner surface of the vacuum envelope 11) for insulating those electrodes. Arcing easily occurs in the interface between the insulating member 21 and the anode A. It is noted that the chromium oxide film 23 is formed so as to continuously connect the anode A, the grid electrode G3 and the insulating member 21. This structural feature prevents arcing from occurring therein.

A chromium oxide film 23 is formed so as to continuously connect the grid electrode G3, the grid electrode G2 and the insulating member 22 for insulating those electrodes. Particularly in an expanding mode, the potential difference between the grid electrode G3 and the grid electrode G2 increases to about 10 kV to sometimes cause arcing. However, no arcing occurs since the chromium oxide film 23 is formed so as to continuously connect the grid electrode G3, the grid electrode G2 and the insulating member 22.

The potential difference between the grid electrode G3 and the grid electrode G1 also increases to about 10 kV to sometimes cause arcing, particularly in an expanding mode. However, no arcing occurs when the chromium oxide film 23 is formed so as to continuously connect the grid electrode G3, the grid electrode G1 and the insulating member for insulating those electrodes, which may be a glass bulb of the vacuum envelope 11.

A composition ratio of the chromium oxide film 23 is set at 25 to 40 atom % of chromium, 1 to 8 atom % of silicon, 0.7 to 5 atom % of potassium as alkali metal, and the remaining part of the content substantially consisting of oxygen. An average particle diameter of chromium oxide particles in the chromium oxide film 23 is 0.5 to 15 μm. A thickness of the chromium oxide film 23 is 5 to 100 μm.

A method for forming the chromium oxide film 23 will be typically described. A liquid-glass aqueous solution containing $Cr_2O_3$ powder having an average particle diameter of 0.9 μm and $SiO_2/K_2O_2$ in 3 molar ratio is measured so as to be within the composition ratio of the chromium oxide film 23, and mixed. At this time, ammonia may be added as a dispersion accelerating agent. Then, the intended portion is coated with the mixture by spray coating, brush coating or the like.

Then, the resultant is baked at 400 to 550° C. In this case, the atmosphere may be an atmosphere of vacuum, air, hydrogen or the like. The vacuum atmosphere is preferable since the most stable conductivity of the film is secured.

Following the baking process, the surface resistance value and the film thickness are measured and visual inspection is conducted if necessary. The resultant film is assembled into the related part, the input surface 16 and the output surface 17 are sealed, the vacuum envelope is evacuated, and the photoelectric surface is formed to complete an image intensifier.

If the atom percentage of the chromium is smaller than 25 atom %, the film conductivity decreases, the secondary electron emission is less suppressed, and the unwanted fluorescence occurs. If the atom percentage of the chromium exceeds 40 atom %, the adhesive force of the film to the film forming portion and the interparticle binding force decrease, and the film is easy to separate from the portion. The likelihood that a foreign matter defect due to the film separation and the unwanted fluorescence occurs increases. In this respect, the atom percentage of the chromium is preferably in the range of 25 to 40 atom %, and to ensure the conductivity of the film, low secondary electron emission and the film separation resistance property, it is preferably in the range of 32 to 36 atom %.

If the atom percentage of the silicon is less than 1 atom %, the adhesive force of the film to the film forming portion and the interparticle binding force decrease, and the film is easy to separate from the portion. The likelihood that a foreign matter defect due to the film separation and the unwanted fluorescence occurs increases. If the atom percentage of the silicon exceeds 8 atom %, the film has an insufficient conductivity. Therefore, a preferable range of the atom percentage of the silicon is 1 to 8 atom %. To ensure the conductivity of the film, low secondary electron emission and the film separation resistance property, it is preferably in the range of 3 to 6 atom %.

If the atom percentage of the potassium is smaller than 0.7 atom %, the adhesive force of the film to the film forming portion and the interparticle binding force decrease, and the film is easy to separate from the portion. The likelihood that a foreign matter defect due to the film separation and the unwanted fluorescence occurs increases. If the atom percentage of the potassium exceeds 5 atom %, the film conductivity is insufficient. Therefore, a preferable range of the atom percentage of the potassium is 0.7 to 5 atom %. To ensure the conductivity of the film, low secondary electron emission and the film separation resistance property, it is preferably in the range of 2 to 4 atom %. The atom presence ratio of the potassium to the silicon is preferably within 0.6 to 0.7%.

An average particle diameter of the chromium oxide particles is preferably in the range of 0.5 to 1.5 μm on the basis of the composition ratio of the chromium oxide film 23. If it is smaller than 0.5 μm, the mixture is easy to agglutinate at the time of its coating, and the film conductivity is too high. If it is larger than 1.5 μm, the film conductivity decreases to be near the insulating film.

The thickness of the chromium oxide film 23 is preferably in the range of 5 to 100 μm. If it is thinner than 5 μm, the secondary electron emission is less suppressed, and the unwanted fluorescence defective increases. If it is thicker than 100 μm, the film is easy to be cracked. For this reason, a preferable range of the film thickness is 5 to 100 μm. To ensure the low secondary electron emission and the increased resistance of the film against the cracking, the film thickness is preferably in the range of 10 to 15 μm.

The alkali metal of the chromium oxide film 23 is preferably potassium. However, it may be replaced with sodium. If necessary, potassium and sodium may both be used for the alkali metal.

The vacuum envelope 11 is contained in a bulb container 25. A high voltage power source 26 for applying high voltage to the plurality of electrodes 19, a camera 27 for picking up a visible light image focused on the output surface 17, and the like are arranged within the bulb container 25. In this way, the image intensifier is formed.

Thus, in the image intensifier of the invention, the chromium oxide film 23 is formed so as to continuously connect the plurality of electrodes 19 and the insulating members 21, 22 for insulating those electrodes 19. With this characteristic feature, an image intensifier which is capable of preventing the intermittent discharge phenomenon and has a high reliability can be provided.

Further, the chromium oxide film 23 having the compositions mentioned above is made of a semiconductor which is not electrically charged. For example, when it receives electrons emitted from the grid electrode G3, it is not charged and has a function to always pass electric charges to the anode A. The chromium oxide film has also a contradictory function to electrically insulate the anode A from the grid electrode G3. Accordingly, it produces no problem of poor insulation.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image intensifier, comprising:

a vacuum envelope having an input window, which is formed in a side thereof on which incident light is incident, and an output window, which is formed in a side thereof opposite to the input window;

an input surface, which is provided on the input window side within the vacuum envelope, and is configured to emit an electron beam corresponding to the incident light;

an output surface, which is provided on the output window side within the vacuum envelope, and is configured to convert the electron beam into a visible light image;

a plurality of electrodes which form an electron lens on a path of the electron beam between the input surface and the output surface;

a plurality of insulating members configured to insulate the plurality of electrodes; and a chromium oxide film, which is formed to continuously connect the plurality of electrodes and the insulating members located between those electrodes, the formed chromium oxide film configured to prevent an intermittent discharge phenomenon from occurring at an interface between at least the electrodes and the insulating members.

2. The image intensifier according to claim 1, wherein said plurality of electrodes are an anode, and a grid electrode close to the anode, and the insulating member is made of glass or ceramic.

3. The image intensifier according to claim 1, wherein a composition ratio of the chromium oxide film is set at 25 to 40 atom % of chromium, 1 to 8 atom % of silicon, 0.7 to 5 atom % of alkali metal, and the remaining part of the composition substantially consisting of oxygen.

4. The image intensifier according to claim 3, wherein the alkali metal is potassium.

5. The image intensifier according to claim 1, wherein an average particle diameter of chromium oxide particles in the chromium oxide film is in the range of 0.5 to 1.5 μm.

6. The image intensifier according to claim 1, wherein a thickness of the chromium oxide film is in the range of 5 to 100 μm.

7. The image intensifier according to claim 2, wherein a composition ratio of the chromium oxide film is set at 25 to 40 atom % of chromium, 1 to 8 atom % of silicon, 0.7 to 5 atom % of alkali metal, and the remaining part of the composition substantially consisting of oxygen.

8. The image intensifier according to claim 7, wherein the alkali metal is potassium.

9. The image intensifier according to claim 2, wherein an average particle diameter of chromium oxide particles in the chromium oxide film is in the range of 0.5 to 1.5 μm.

10. The image intensifier according to claim 2, wherein a thickness of the chromium oxide film is in the range of 5 to 100 μm.

11. The image intensifier according to claim 3, wherein an average particle diameter of chromium oxide particles in the chromium oxide film is in the range of 0.5 to 1.5 μm.

12. The image intensifier according to claim 3, wherein a thickness of the chromium oxide film is in the range of 5 to 100 μm.

13. The image intensifier according to claim 4, wherein an average particle diameter of chromium oxide particles in the chromium oxide film is in the range of 0.5 to 1.5 μm.

14. The image intensifier according to claim 4, wherein a thickness of the chromium oxide film is in the range of 5 to 100 μm.

15. The image intensifier according to claim 5, wherein a thickness of the chromium oxide film is in the range of 5 to 100 μm.

* * * * *